US010208679B2

(12) United States Patent
Pursifull

(10) Patent No.: US 10,208,679 B2
(45) Date of Patent: Feb. 19, 2019

(54) SYSTEMS AND METHODS FOR MULTIPLE ASPIRATORS FOR A CONSTANT PUMP RATE

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 182 days.

(21) Appl. No.: 15/226,843

(22) Filed: Aug. 2, 2016

(65) Prior Publication Data

US 2016/0341132 A1 Nov. 24, 2016

Related U.S. Application Data

(63) Continuation of application No. 13/962,526, filed on Aug. 8, 2013, now Pat. No. 9,404,453.

(51) Int. Cl.
*F02D 9/02* (2006.01)
*F02M 35/10* (2006.01)

(52) U.S. Cl.
CPC ..... *F02D 9/02* (2013.01); *F02M 35/10118* (2013.01); *F02M 35/10229* (2013.01);
(Continued)

(58) Field of Classification Search
CPC .. F02M 35/10229; F02M 25/06; F02B 67/04; F02D 9/02; B60T 13/52
(Continued)

(56) References Cited

U.S. PATENT DOCUMENTS 4,270,508 A * 6/1981 Lindberg ..... F01M 13/023 123/25 A
9,097,149 B2 8/2015 Beshay et al.
(Continued)

FOREIGN PATENT DOCUMENTS

| | | | |
|---|---|---|---|
| CN | 201195500 | Y | 2/2009 |
| CN | 102678342 | A | 9/2012 |
| WO | 2009047249 | A2 | 4/2009 |

OTHER PUBLICATIONS

State Intellectual Property Office of the People's Republic of China, Office Action and Search Report Issued in Application No. 201410352776.X, dated Oct. 27, 2017, 10 pages. (Submitted with Partial Translation).

*Primary Examiner* — Syed O Hasan
(74) *Attorney, Agent, or Firm* — Julia Voutyras; McCoy Russell LLP

(57) ABSTRACT

Methods and systems are provided for a parallel arrangement of at least two valved aspirators, with a high pressure source such as an intake throttle inlet coupled to a motive inlet of the arrangement and a low pressure sink such as an intake throttle outlet coupled to a mixed flow outlet of the arrangement. Intake throttle position and respective valves arranged in series with each aspirator of the arrangement are controlled based on intake manifold pressure and/or a desired engine air flow rate, for example such that a combined motive flow rate through the arrangement increases as intake manifold pressure increases. An intake throttle with a fully closed default position may be used in conjunction with the arrangement; during a fault condition where the intake throttle is fully closed, the valves of the arrangement may be controlled to achieve a controllable engine air flow rate during the fault condition.

20 Claims, 6 Drawing Sheets

(52) U.S. Cl.
CPC ..... *F02M 35/10255* (2013.01); *F02M 35/10386* (2013.01); *F02D 2009/022* (2013.01); *F02D 2009/0235* (2013.01); *F02D 2009/0279* (2013.01)

(58) Field of Classification Search
USPC ..... 123/184.21, 184.56
See application file for complete search history.

(56) References Cited

U.S. PATENT DOCUMENTS

| | | | | |
|---|---|---|---|---|
| 9,103,288 | B2 | 8/2015 | Pursifull | |
| 9,347,368 | B2 | 5/2016 | Ulrey et al. | |
| 2011/0132311 | A1* | 6/2011 | Pursifull | F02M 35/10229 123/184.56 |
| 2012/0036997 | A1* | 2/2012 | Millner | C21B 5/06 95/22 |
| 2013/0233287 | A1 | 9/2013 | Leone | |
| 2014/0076294 | A1 | 3/2014 | Ulrey et al. | |
| 2014/0165962 | A1 | 6/2014 | Pursifull | |
| 2014/0297163 | A1 | 10/2014 | Kragh | |

* cited by examiner

450

| ASOV POSITION (3.5 MM THROAT DIAMETER ASPIRATOR) | ASOV POSITION (5 MM THROAT DIAMETER ASPIRATOR) | COMBINED MOTIVE FLOW RATE THROUGH ASPIRATOR ARRANGEMENT | INTAKE MANIFOLD VACUUM LEVEL |
|---|---|---|---|
| CLOSED | CLOSED | 0 | 40 kPa < MANVAC |
| OPEN | CLOSED | LEVEL 1X | 35 kPa < MANVAC ≤ 40 kPa |
| CLOSED | OPEN | LEVEL 2X | 30 kPa < MANVAC ≤ 35 kPa |
| OPEN | OPEN | LEVEL 3X | 0 kPa < MANVAC ≤ 30 kPa |

SYSTEMS AND METHODS FOR MULTIPLE ASPIRATORS FOR A CONSTANT PUMP RATE

CROSS REFERENCE TO RELATED APPLICATIONS

The present application is a continuation of U.S. patent application Ser. No. 13/962,526, entitled "SYSTEMS AND METHODS FOR MULTIPLE ASPIRATORS FOR A CONSTANT PUMP RATE," filed on Aug. 8, 2013, now U.S. Pat. No. 9,404,453, the entire contents of which are hereby incorporated by reference for all purposes.

FIELD

The present invention relates to a parallel arrangement of valved aspirators coupled to an engine system. A combined motive flow rate through the aspirators may be controlled to achieve a pumping performance comparable to that of a conventional electrically-driven or engine-driven vacuum pump.

BACKGROUND AND SUMMARY

Vehicle engine systems may include various vacuum consumption devices that are actuated using vacuum. These may include, for example, a brake booster. Vacuum used by these devices may be provided by a dedicated vacuum pump, such as an electrically-driven or engine-driven vacuum pump. While such vacuum pumps advantageously produce a pumping curve that is independent of intake manifold pressure, they do so at the expense of fuel and/or energy efficiency. As an alternative to such resource-consuming vacuum pumps, one or more aspirators may be coupled in an engine system to harness engine airflow for generation of vacuum. Aspirators (which may alternatively be referred to as ejectors, venturi pumps, jet pumps, and eductors) are passive devices which provide low-cost vacuum generation when utilized in engine systems. An amount of vacuum generated at an aspirator can be controlled by controlling the motive air flow rate through the aspirator. For example, when incorporated in an engine intake system, aspirators may generate vacuum using energy that would otherwise be lost to throttling, and the generated vacuum may be used in vacuum-powered devices such as brake boosters.

While aspirators may generate vacuum at a lower cost and with improved efficiency as compared to vacuum pumps, their use in engine intake systems has traditionally been constrained by intake manifold pressure. Whereas conventional vacuum pumps produce a pumping curve which is independent of intake manifold pressure, pumping curves for aspirators arranged in engine intake systems may be unable to consistently provide a desired performance over a range of intake manifold pressures. Some approaches for addressing this issue involve arranging a valve in series with an aspirator, or incorporating a valve into the structure of an aspirator. An opening amount of valve is then controlled to control the motive air flow rate through the aspirator, and thereby control an amount of vacuum generated at the aspirator. By controlling the opening amount of the valve, the amount of air flowing through the aspirator and the air flow rate can be varied, thereby adjusting vacuum generation as engine operating conditions such as intake manifold pressure change. However, such valves can add significant component and operating costs to engine systems. As a result, the cost of including the valve may reduce the advantages of aspirator vacuum control.

To address at least some of these issues, the inventors herein have identified a parallel, valved aspirator arrangement which, when incorporated in an engine system, may advantageously produce a pumping curve comparable to that of a conventional driven vacuum pump without the costs and efficiency losses of a conventional vacuum pump. For example, the inventors herein have recognized that the valves of multiple valved aspirators arranged in parallel and bypassing an intake throttle may be controlled based on intake manifold vacuum and/or based on desired engine airflow to minimize throttling losses while generating vacuum for use with vacuum-powered devices. Because multiple, parallel aspirators are used, each aspirator may have a relatively small flow diameter and yet the arrangement can still achieve an overall motive flow rate commensurate with that of a single larger aspirator when needed. The relatively small flow diameters of the aspirators enable the use of smaller, cheaper valves controlling their motive flow. Further, relative flow diameters of the parallel aspirators may be strategically selected such that the valves of the aspirators may be controlled based on intake manifold vacuum level and/or desired engine airflow to produce a desired pumping curve. Furthermore, because the combined motive flow rate through the aspirator arrangement is controllable via the valves, conditions where the motive flow through the aspirators may cause air flow greater than desired may be reduced. Thus, since air flow rate greater than desired can lead to extra fuel being injected, fuel economy may be improved by use of the aspirator arrangement.

In one example, a method for an engine includes increasing a combined motive flow rate through a parallel aspirator arrangement of at least two valved aspirators bypassing an intake throttle as intake manifold pressure increases. This method takes advantage of the engine's ability to handle a greater throttle bypass flow rate as intake manifold pressure increases by controlling the valves of the valved aspirators of the aspirator arrangement such that the combined motive flow rate through the aspirator arrangement increases with increasing intake manifold pressure. When the combined motive flow rate through the aspirator arrangement increases, it follows that the vacuum generated by the aspirator arrangement increases, and therefore a pumping curve which resembles a vacuum pump's pumping curve (e.g., which is independent of intake manifold) may be achieved by the aspirator arrangement. Accordingly, the technical result achieved via this example method is the generation of vacuum by a parallel valved aspirator arrangement in quantities that are substantially independent of intake manifold pressure, while continuing to supply an appropriate engine air flow rate. In embodiments where the aspirator arrangement bypasses the intake throttle, the intake throttle may be adjusted to supply a difference between a desired engine air flow rate and a maximum combined motive flow rate through the aspirator arrangement.

Further, the inventors herein have recognized that the parallel valved aspirator arrangement described herein may advantageously supply a sufficient, controllable engine air flow rate during intake throttle fault conditions. Accordingly, a cheaper intake throttle may be used instead of a more costly intake throttle with a partially open unpowered position which is often used in engine systems to allow for sustained engine operation in the case of malfunction of electronic throttle control.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
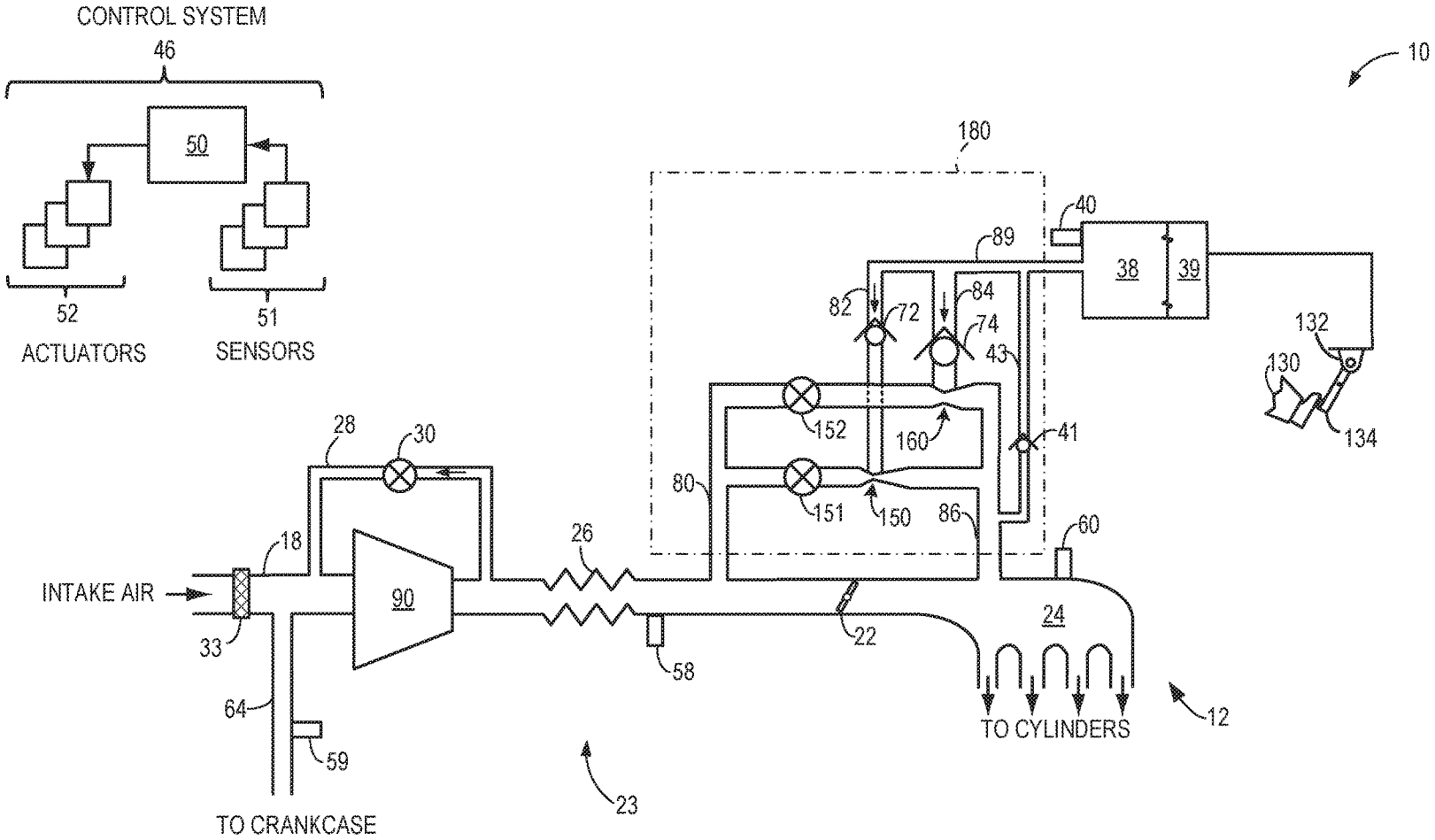
FIG. 1 shows a schematic diagram of an example engine system including a parallel valved aspirator arrangement bypassing an intake throttle.
Figure 5:
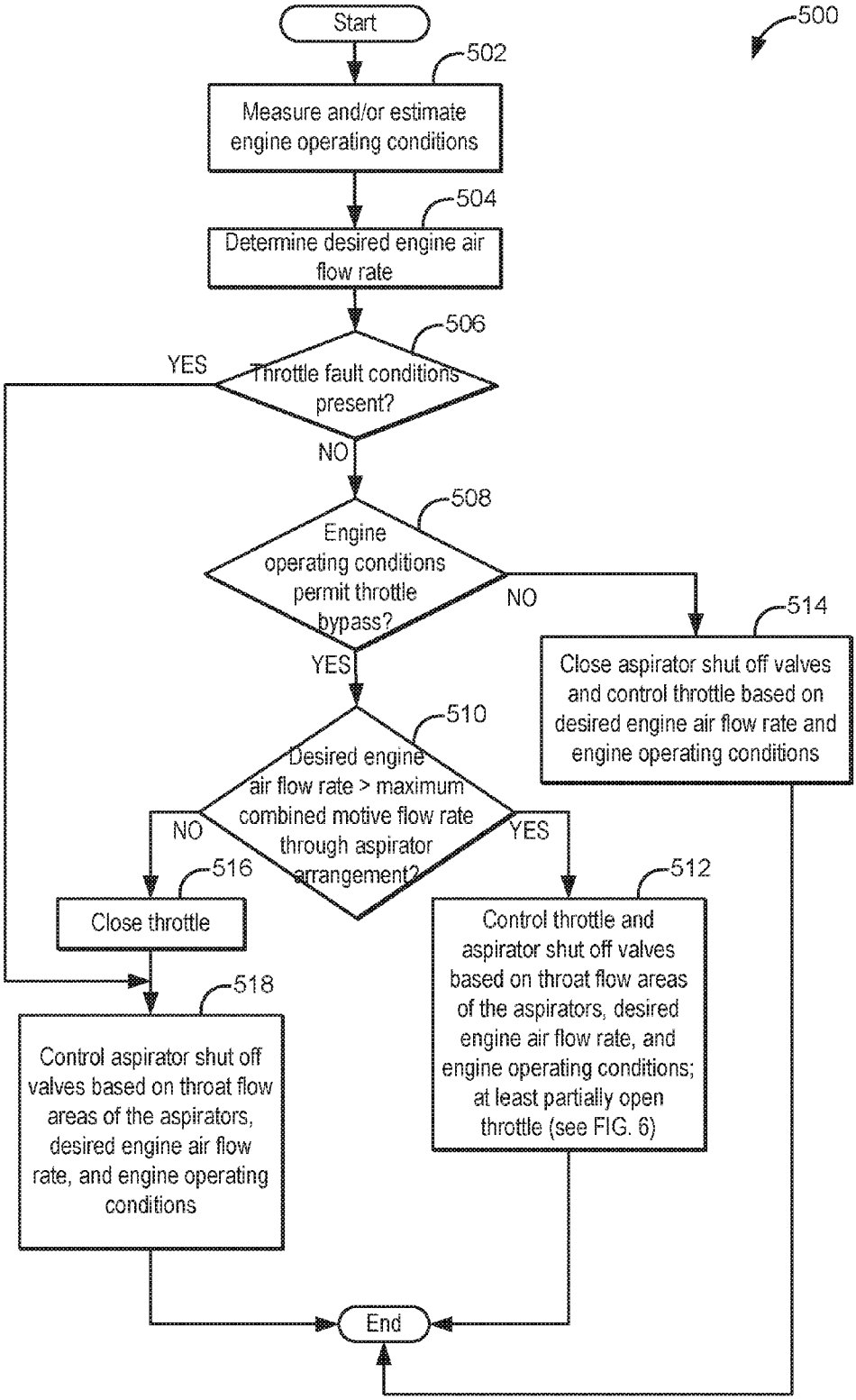
FIG. 5 shows a high level flow chart illustrating a routine that may be implemented for controlling the operation of an aspirator arrangement such as the aspirator arrangement shown in FIGS. 1-2 and/or the aspirator arrangement referred to in FIGS. 4A-B.
Figure 6:
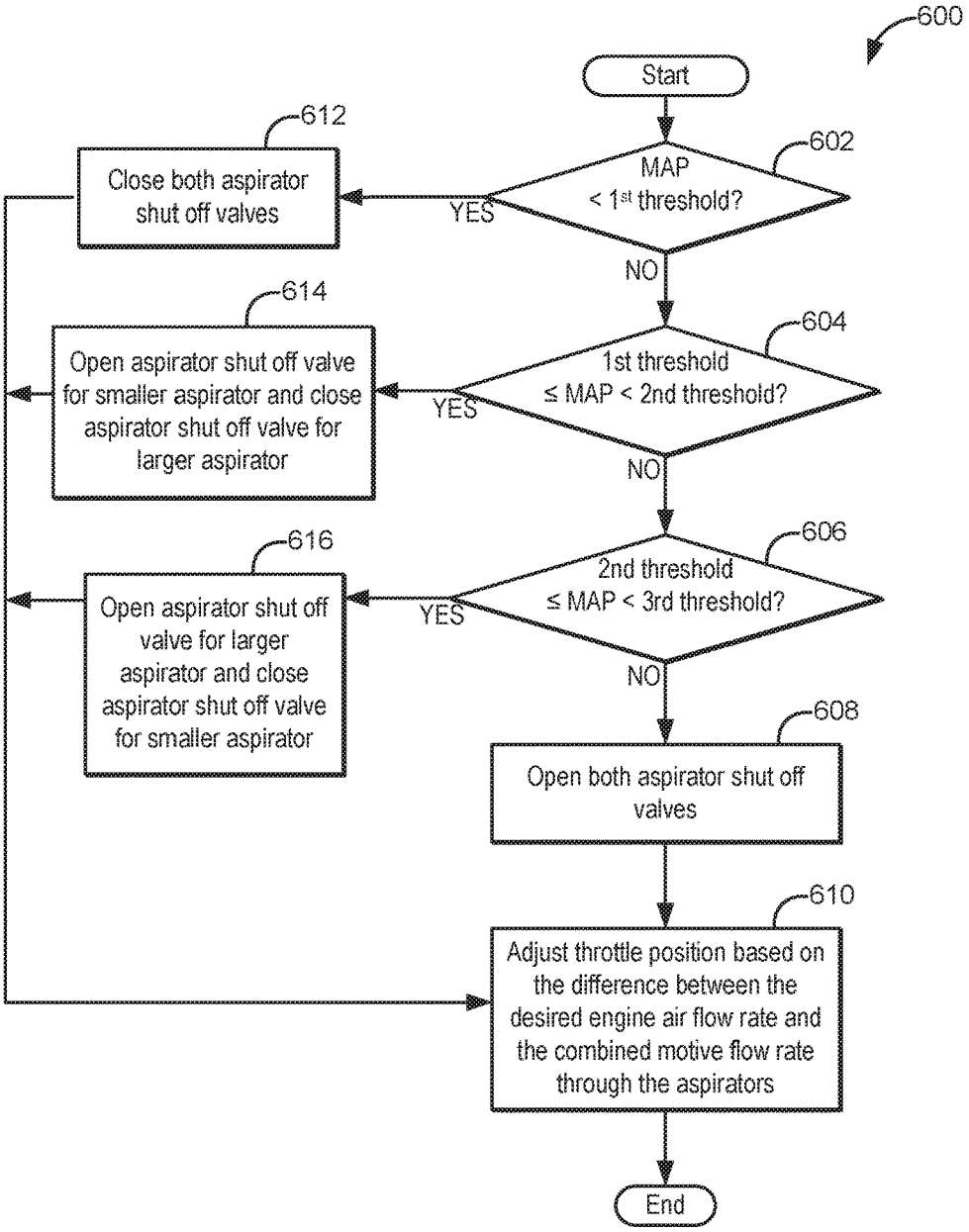
FIG. 6 shows a high level flow chart illustrating a routine for controlling an intake throttle and aspirator shut-off valves, which may be used in conjunction with the method of FIG. 3 and/or the method of FIG. 5.

Methods and systems are provided for controlling a motive flow rate through a parallel arrangement of valved aspirators coupled to an engine system, such as the engine systems of FIG. 1. A detail view of an aspirator arrangement which may be included in the engine system of FIG. 1 is provided in FIG. 2. A combined motive flow rate through the aspirator arrangement may be adjusted via control of aspirator shut-off valves of the aspirator arrangement, for example as a function of intake manifold pressure. By adjusting the aspirator shut-off valves to increase motive flow through the aspirators as intake manifold pressure increases (e.g., as intake manifold vacuum decreases), and by directing some flow through the intake throttle when a desired engine air flow rate exceeds a maximum combined motive flow rate through the aspirator arrangement (FIGS. 4A-B), a desired engine air flow rate may be achieved over a range of intake manifold pressures and more vacuum may be generated at the aspirators for use by engine vacuum consumption devices. During throttle fault conditions, the throttle may be bypassed such at the intake air charge flows through the aspirator arrangement and engine air flow rate may be controlled via control of the aspirator shut-off valves to advantageously provide a controllable air flow rate even during electronic throttle control failure (FIGS. 5-6). Accordingly, the aspirator arrangement described herein may achieve a pumping performance similar to that of a vacuum pump without the increased cost and decreased efficiency typically associated with a vacuum pump, and with decreased throttling losses.

Turning to FIG. 1, it shows an example engine system 10 including an engine 12. In the present example, engine 12 is a spark-ignition engine of a vehicle, the engine including a plurality of cylinders (not shown). Combustion events in each cylinder drive a piston which in turn rotates a crankshaft, as is well known to those of skill in the art. Further, engine 12 may include a plurality of engine valves for controlling the intake and exhaust of gases in the plurality of cylinders.

Engine 12 includes a control system 46. Control system 46 includes a controller 50, which may be any electronic control system of the engine system or of the vehicle in which the engine system is installed. Controller 50 may be configured to make control decisions based at least partly on input from one or more sensors 51 within the engine system, and may control actuators 52 based on the control decisions. For example, controller 50 may store computer-readable instructions in memory, and actuators 52 may be controlled via execution of the instructions.

Engine 12 has an engine intake 23 that includes an air intake throttle 22 fluidly coupled to an engine intake manifold 24 along an intake passage 18. Air may enter intake passage 18 from an air intake system including an air cleaner 33 in communication with the vehicle's environment. A position of throttle 22 may be varied by controller 50 via a signal provided to an electric motor or actuator included with the throttle 22, a configuration that is commonly referred to as electronic throttle control. In this manner, the throttle 22 may be operated to vary the intake air provided to the intake manifold and the plurality of engine cylinders. As discussed above, whereas motorized throttles are often designed to default to a 6° or 7° open position when unpowered, for example so that the engine may receive enough air flow to complete a current trip even in the case of failure of the electronic throttle control (sometimes referred to as "limp home" operation), throttle 22 may have a fully closed default position. A fully closed default position may be used in conjunction with the parallel valved aspirator arrangement described herein because the combined motive flow through the arrangement may be sufficient in the case of electronic throttle control failure (e.g., the combined motive flow rate of the aspirator arrangement may be 7.5 grams per second (g/s) in one non-limiting example). In this way, as discussed above, the costly partially open unpowered position of the intake throttle may be eliminated. As a further advantage over the partially open unpowered position of the intake throttle, the parallel valved aspirator arrangement provides multiple airflow levels for use during the fault mode, depending on the number of aspirators in the arrangement, providing better performance during limp home operation.

A mass air flow (MAF) sensor 58 may be coupled in intake passage 18 for providing a signal regarding mass air flow in the intake passage to controller 50. While MAF sensor 58 is arranged downstream of the charge air cooler and upstream of aspirator arrangement 180 in the embodiment depicted in FIG. 1, it will be appreciated that MAF sensor 58 may be coupled elsewhere in the intake system or engine system, and further, there may be one or more additional MAF sensors arranged in the intake system or engine system. Further, a sensor 60 may be coupled to intake manifold 24 for providing a signal regarding manifold air pressure (MAP) and/or manifold vacuum (MANVAC) to controller 50. For example, sensor 60 may be a pressure sensor or a gauge sensor reading vacuum, and may transmit data as negative vacuum (e.g., pressure) to controller 50.

In some examples, additional pressure/vacuum sensors may be coupled elsewhere in the engine system to provide signals regarding pressure/vacuum in other areas of the engine system to controller 50.

In some embodiments, engine system 10 is a boosted engine system, where the engine system further includes a boosting device. In the present example, intake passage 18 includes a compressor 90 for boosting an intake air charge received along intake passage 18. A charge air cooler (or intercooler) 26 is coupled downstream of compressor 90 for cooling the boosted air charge before delivery to the intake manifold. In embodiments where the boosting device is a turbocharger, compressor 90 may be coupled to and driven by an exhaust turbine (not shown). Further compressor 90 may be, at least in part, driven by an electric motor or the engine crankshaft.

An optional bypass passage 28 may be coupled across compressor 90 so as to divert at least a portion of intake air compressed by compressor 90 back upstream of the compressor. An amount of air diverted through bypass passage 28 may be controlled by opening compressor bypass valve (CBV) 30 located in bypass passage 28. By controlling CBV 30, and varying an amount of air diverted through the bypass passage 28, a boost pressure provided downstream of the compressor can be regulated. This configuration enables boost control and surge control.

In some embodiments, engine system 10 may include a positive crankcase ventilation (PCV) system (not shown) that is coupled to the engine intake so that gases in the crankcase may be vented in a controlled manner from the crankcase. Therein, during non-boosted conditions (when MAP is less than barometric pressure (BP)), air is drawn into the crankcase via a breather or vent tube 64. Crankcase ventilation tube 64 may be coupled to fresh air intake passage 18 upstream of compressor 90. In some examples, the crankcase ventilation tube 64 may be coupled downstream of air cleaner 33 (as shown). In other examples, the crankcase ventilation tube may be coupled to intake passage 13 upstream of air cleaner 33. As shown in FIG. 1, a pressure sensor 59 may be coupled in the crankcase vent tube 64 to provide a signal regarding the crankcase vent tube pressure/compressor inlet pressure to controller 50.

Engine system 10 further includes a parallel valved aspirator arrangement 180. In the depicted embodiment, for the sake of example, aspirator arrangement 180 includes two aspirators, aspirators 150 and 160; however, it will be appreciated that aspirator arrangement 180 may include more than two aspirators (e.g., three, four, five, six, or more aspirators) arranged in parallel without departing from the scope of this disclosure. One or both of aspirators 150 and 160 may be ejectors, aspirators, eductors, venturis, jet pumps, or similar passive devices. Each aspirator of aspirator arrangement 180 is a three-port device including a motive inlet, a mixed flow outlet, and an entraining inlet arranged at a throat of the aspirator. For example, aspirator 150 includes a motive inlet 153, a mixed flow outlet 157, a throat 161, and an entraining inlet 165. Similarly, aspirator 160 includes a motive inlet 154, a mixed flow outlet 156, a throat 163, and an entraining inlet 167. As described further below, motive flow through each aspirator generates a suction flow at the entraining inlet of the aspirator, thereby generating vacuum, e.g. which may be stored in a vacuum reservoir and provided to various vacuum consumers of the engine system.

An aspirator shut-off valve (ASOV) is arranged in series with each aspirator of aspirator arrangement 180. In the embodiment depicted in FIG. 1, ASOV 151 is arranged in series with and upstream of aspirator 150, and ASOV 152 is arranged in series with and upstream of aspirator 160. Specifically, ASOV 151 is arranged upstream of the motive inlet 153 of aspirator 150 and downstream of a motive inlet 145 of aspirator arrangement 180, and similarly, ASOV 152 is arrangement upstream of a motive inlet 154 of aspirator 160 and downstream of motive inlet 145 of aspirator arrangement 180. However, it will be appreciated that in other embodiments, the ASOVs may be arranged downstream of mixed flow outlets of the aspirators, or the ASOVs may be integral to the aspirators (e.g., the valves may be arranged at the throats of the aspirators). One advantage of positioning an ASOV upstream of a corresponding aspirator is that when the ASOV is upstream, the pressure loss associated with the ASOV has less of an impact as compared to a configuration where the ASOV is downstream of the aspirator or integral to the aspirator.

In the embodiments described herein, ASOVs 151 and 152 are solenoid valves which are actuated electrically, and the state of each ASOV may be controlled by controller 50 based on various engine operating conditions. However, as an alternative, the ASOVs may be pneumatic (e.g., vacuum-actuated) valves; in this case, the actuating vacuum for the valves may be sourced from the intake manifold and/or vacuum reservoir and/or other low pressure sinks of the engine system. For example, because it may be advantageous to increase a combine flow through the aspirator arrangement as intake manifold pressure increases as described herein, it may be advantageous to use vacuum-actuated ASOVs which are actuated based on intake manifold vacuum. Actuation thresholds of such vacuum-actuated valves may be different for different aspirators to achieve different desired combined flow levels through the aspirator arrangement. In embodiments where the ASOVs are pneumatically-controlled valves, control of the ASOVs may be performed independent of a powertrain control module (e.g., the ASOVs may be passively controlled based on pressure/vacuum levels within the engine system).

Whether they are actuated electrically or with vacuum, ASOVs 151 and 152 may be either binary valves (e.g. two-way valves) or continuously variable valves. Binary valves may be controlled either fully open or fully closed (shut), such that a fully open position of a binary valve is a position in which the valve exerts no flow restriction, and a fully closed position of a binary valve is a position in which the valve restricts all flow such that no flow may pass through the valve. In contrast, continuously variable valves may be partially opened to varying degrees. Embodiments with continuously variable ASOVs may provide greater flexibility in control of the combined motive flow rate of the aspirator arrangement, with the drawback that continuously variable valves may be much more costly than binary valves. In other examples, ASOVs 151 and 152 may be gate valves, pivoting plate valves, poppet valves, or another suitable type of valve.

As detailed herein with reference to FIGS. 3-6, the states of valves 151 and 152 may be adjusted based on various engine operating conditions, to thereby vary a combined motive flow (e.g., a combined motive flow amount and/or rate) through the aspirator arrangement. As used herein, a state of a valve may be fully open, partially open (to varying degrees), or fully closed. In one example, the state of each ASOV may be adjusted based on intake manifold pressure (e.g., such that the combined flow through the aspirator arrangement increases with increasing intake manifold pressure). In another example, the state of each ASOV may be adjusted based on a desired engine air flow amount and/or rate. It will be appreciated that references to adjustment of the ASOVs may refer to either active control via controller 50 (e.g., as in the embodiment depicted in FIG. 1 where the ASOVs are solenoid valves) or passive control based on vacuum actuation thresholds of the ASOVs themselves (e.g., in embodiments where the ASOVs are vacuum-actuated valves). Alternatively or additionally, the states of the ASOVs may be adjusted based on a level of vacuum stored in vacuum reservoir 38, e.g. to increase a combined flow through the aspirator arrangement responsive to a low vacuum condition when such operation is permissible in view of current engine operating conditions. Thus, by varying the motive flow through the aspirators 150 and 160 via adjustment of the state of ASOVs 151 and 152, an amount of vacuum drawn at the entraining inlets of the aspirators may be modulated to meet engine vacuum requirements.

In the example embodiment depicted in FIG. 1, a passage 80 couples aspirator arrangement 180 with intake passage 18 at a point downstream of charge air cooler 26 and upstream of throttle 22. As shown, passage 80 branches into parallel flow paths, each flow path including one aspirator of the aspirator arrangement; a portion of passage 80 upstream of the branching point will be referred to herein as the motive inlet 145 of aspirator arrangement 180 (see FIG. 2). Further, as shown in FIG. 1, a passage 86 couples aspirator arrangement 180 with intake manifold 24. As shown, the parallel flow paths containing the aspirators of the aspirator arrangement merge at passage 86; a portion of passage 86 downstream of the merging point will be referred to herein as mixed flow outlet 147 of aspirator arrangement 180 (see FIG. 2). Thus, it will be appreciated that while each individual aspirator is a three-port device including a motive inlet, a mixed flow outlet, and a throat/entraining inlet, the aspirator arrangement itself also has a motive inlet and a mixed flow outlet. Fluid flow entering the motive inlet of the aspirator arrangement may be diverted through one or more of the aspirators depending on the positions of the ASOVs. A mixture of the fluid flow from the motive inlet and the suction flow entering each aspirator through its entraining inlet ("mixed flow") exits the mixed flow outlet of the aspirator and combines with the mixed flow of the other aspirators of the aspirator arrangement before exiting the aspirator arrangement via the mixed flow outlet 147 of the aspirator arrangement.

While the example engine system depicted in FIG. 1 includes an aspirator arrangement bypassing the intake throttle, it will be appreciated that the motive inlet of an aspirator arrangement such as aspirator arrangement 180 may be coupled to any high pressure source in the engine system (e.g., the atmosphere, engine exhaust, engine crankcase, compressor inlet, intake throttle inlet, compressor outlet, or charge air cooler outlet). Further, the mixed flow outlet of an aspirator arrangement such as aspirator arrangement 180 may be coupled to any low pressure sink in the engine system (e.g., the intake manifold, air inlet, crankcase, intake throttle outlet, or compressor inlet). Alternatively, the individual aspirators of the aspirator arrangement may each have different high pressure sources while sharing a same low pressure sink (e.g., the aspirator arrangement may have a common mixed flow outlet but may not have a common motive inlet). In one non-limiting example, the high pressure source of a first, smaller aspirator of the aspirator arrangement may be crankcase ventilation, the high pressure source of a second, larger aspirator of the aspirator arrangement may be throttle inlet air, and the two aspirators may have a common low pressure sink (e.g., the intake manifold). In this example, an entraining inlet of the smaller aspirator may be coupled to a fuel vapor purge system, whereas an entraining inlet of the larger aspirator may be coupled to another vacuum source such as a vacuum reservoir or a vacuum consumption device.

Returning to the aspirators of aspirator arrangement 180, a throat flow area (e.g., a cross-sectional flow area through the throat of the aspirator) of the aspirators may be non-uniform in some examples. For example, as may be seen in the detail view of aspirator arrangement 180 depicted in FIG. 2, throat 161 of aspirator 150 has a diameter $d_1$, and throat 163 of aspirator 160 has a diameter $d_2$. As shown the diameter $d_1$ and the resulting cross-sectional flow area through aspirator 150 is smaller than the diameter $d_2$ and the resulting cross-sectional flow area through aspirator 160. In one example, the ratio of diameters $d_1$ to $d_2$ may be 3.5 to 5; in this case, $d_1$ may be 3.5 mm and $d_2$ may be 5 mm. With this ratio of diameters, the cross-sectional flow area at the throat of aspirator 150 is roughly half as large as the cross-sectional flow area at the throat of aspirator 160 (e.g., if $d_1$ and $d_2$ are 3.5 mm and 5 mm, respectively, the resulting cross-sectional flow areas at the throats of aspirators 150 and 160 are approximately 9.62 $mm^2$ and 19.63 $mm^2$, respectively). Such a relationship between throat flow areas of aspirators in the aspirator arrangement may advantageously provide greater flexibility for the combined motive flow through the aspirator, as detailed herein. In embodiments with greater than two aspirators in the aspirator arrangement, all of the aspirators of aspirator arrangement 180 may have different diameters/cross-sectional areas (e.g., none of the aspirators having the same diameter/cross-sectional flow area). Alternatively, in such embodiments, only some of the aspirators of the aspirator arrangement may have different diameters/cross-sectional flow areas (in which case at least two aspirators of the arrangement will have the same diameter/cross-sectional flow area). In further example aspirator arrangements having at least two aspirators, all of the aspirators of the aspirator arrangement may have the same, uniform diameter and cross-sectional flow area. It will be appreciated that in examples where cross-sections of the aspirators (e.g., at the throats of the aspirators) are not circular and are instead elliptical or rectangular, among other examples, it may not be relevant to refer to diameters of the aspirators; in such examples, other parameters may be referred to such as cross-sectional flow area.

Further, in some examples, each parallel flow path may itself branch into further parallel flow paths each containing one or more aspirators with either the same or different diameters/cross-sectional flow areas at their throats, e.g. downstream of the ASOV, which then merge into a single flow path upstream of the passage at which all of the parallel flow paths merge upstream of the low pressure sink (e.g., the intake manifold). Such configurations may provide further flexibility in controlling engine air flow rate and vacuum generation, e.g. during a throttle fault condition where the throttle is in a fully closed position and all airflow is directed through the aspirator arrangement. In such examples, the aspirators may have a common high pressure source such as throttle inlet pressure (TIP) but different low pressure sinks such as the intake manifold and compressor inlet pressure (CIP).

As previously mentioned, each aspirator of aspirator arrangement 180 includes an entraining inlet at the throat of the aspirator. In the example embodiment depicted in FIG. 1, entraining inlet 165 of aspirator 150 communicates with a vacuum reservoir 38 by way of a passage 82. Due to the converging-diverging shape of aspirator 150, the flow of fluid such as air from motive inlet 154 to mixed flow outlet 156 of aspirator 150 may generate a low pressure at throat 161 and therefore at entraining inlet 165. This low pressure may induce a suction flow from passage 82 into throat 161 of aspirator 150, thereby generating vacuum at vacuum reservoir 38. A check valve 72 arranged in passage 82 prevents backflow from aspirator 150 to vacuum reservoir 38, thereby allowing vacuum reservoir 38 to retain its vacuum should the pressures at the motive inlet of aspirator 150 and the vacuum reservoir equalize. While the depicted embodiment shows check valve 72 as a distinct valve, in alternate embodiments, check valve 72 may be integrated into the aspirator. Like aspirator 150, entraining inlet 167 of aspirator 160 communicates with vacuum reservoir 38 by way of a passage 84, and motive flow through aspirator 160 may induce a suction flow from passage 84 into throat 163 of aspirator 160, thereby generating vacuum at vacuum reservoir 38. Like check valve 72 described above, a check valve 74 arranged in passage 84 prevents backflow from aspirator 160 to vacuum reservoir 38. It will be appreciated that because mixed flow outlet 147 of aspirator arrangement 180 communicates with intake manifold 24, check valves 72 and 74 prevent fluid flow from the intake manifold to the vacuum reservoir, e.g. which might otherwise occur during conditions when intake manifold pressure is higher than a pressure in the vacuum reservoir. Similarly, check valves 72 and 74 prevent fluid such as an intake air charge from flowing from passage 80 into vacuum reservoir 38. As shown in FIG. 1, passages 82 and 84 merge into a common passage 89 which enters vacuum reservoir 38. However, in other examples, passages 82 and 84 may each enter the vacuum reservoir at different ports.

Vacuum reservoir 38 may be coupled to one or more engine vacuum consumption devices 39. In one non-limiting example, a vacuum consumption device 39 may be a brake booster coupled to vehicle wheel brakes wherein vacuum reservoir 38 is a vacuum cavity in front of a diaphragm of the brake booster, as shown in FIG. 1. In such an example, vacuum reservoir 38 may be an internal vacuum reservoir configured to amplify a force provided by a vehicle operator 130 via a brake pedal 134 for applying vehicle wheel brakes (not shown). A position of the brake pedal 134 may be monitored by a brake pedal sensor 132. In alternate embodiments, the vacuum reservoir may be a low pressure storage tank included in a fuel vapor purge system, a vacuum reservoir coupled to a turbine wastegate, a vacuum reservoir coupled to a charge motion control valve, etc. In such embodiments, vacuum consumption devices 39 of the vehicle system may include various vacuum-actuated valves such as charge motion control valves, a 4×4 hub lock, switchable engine mounts, heating, ventilation and cooling, vacuum leak checks, crankcase ventilation, exhaust gas recirculation, gaseous fuel systems, compressor bypass valves (e.g., CBV 30 shown in FIG. 1), wheel-to-axle disconnect, etc. In one example embodiment, anticipated vacuum consumption by the vacuum consumers during various engine operating conditions may be stored in a lookup table in memory of the control system, for example, and the stored vacuum threshold corresponding to anticipated vacuum consumption for current engine operating conditions may be determined by referencing the lookup table. In some embodiments, as depicted, a sensor 40 may be coupled to the vacuum reservoir 38 for providing an estimate of the vacuum level at the reservoir. Sensor 40 may be a gauge sensor reading vacuum, and may transmit data as negative vacuum (e.g., pressure) to controller 50. Accordingly, sensor 40 may measure the amount of vacuum stored in vacuum reservoir 38.

As shown, vacuum reservoir 38 may be directly or indirectly coupled to intake manifold 24 via a check valve 41 arranged in a bypass passage 43. Check valve 41 may allow air to flow to intake manifold 24 from vacuum reservoir 38 and may limit air flow to vacuum reservoir 38 from intake manifold 24. During conditions where the intake manifold pressure is negative, the intake manifold may be a vacuum source for vacuum reservoir 38. In examples where vacuum consumption device 39 is a brake booster, inclusion of the bypass passage 43 in the system may ensure that the brake booster is evacuated nearly instantaneously whenever intake manifold pressure is lower than brake booster pressure. While the depicted embodiment shows bypass passage 43 coupling common passage 89 with passage 86 in a region of mixed flow outlet 147 of the aspirator arrangement; other direct or indirect couplings of the intake manifold and the vacuum reservoir are also anticipated.

Figure 3:
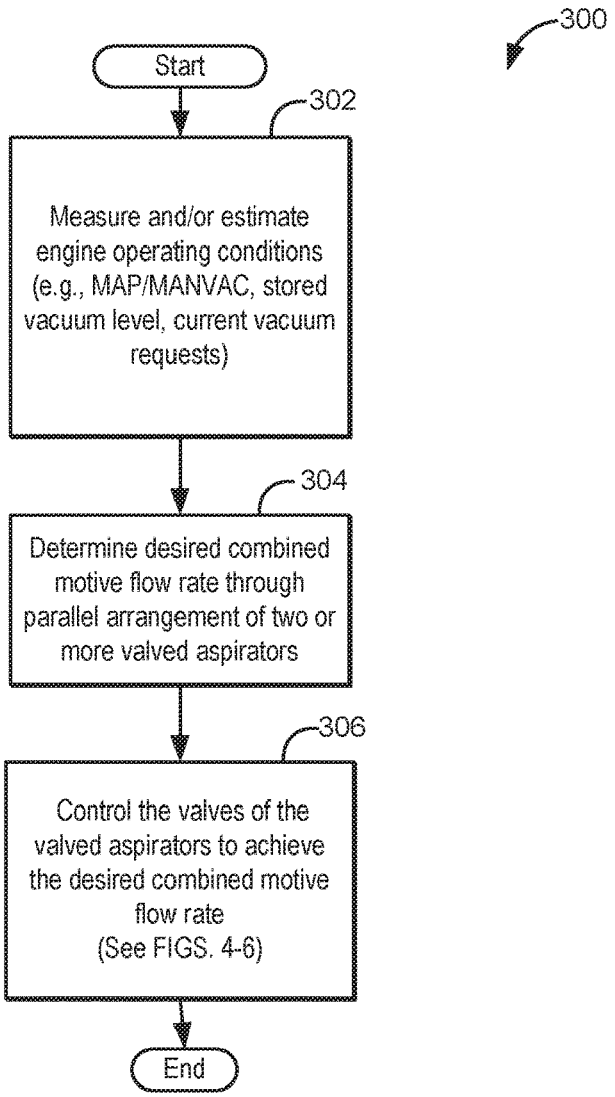
FIG. 3 shows a high level flow chart illustrating a routine that may be implemented in conjunction with the engine system of FIG. 1 and aspirator arrangement of FIG. 2 for controlling the operation of aspirator shut-off valves to adjust a combined motive flow rate through an aspirator arrangement.

Now referring to FIG. 3, an example method 300 for controlling the ASOVs to achieve a desired combined motive flow rate through the aspirator arrangement is shown. The method of FIG. 3 may be used in conjunction with the graph and table of FIGS. 4A-B and the methods of FIGS. 5 and 6.

At 302, method 300 includes measuring and/or estimating engine operating conditions. Engine operating conditions may include, for example, MAP/MANVAC, stored vacuum level (e.g., in the vacuum reservoir), desired level of stored vacuum based on vacuum requests from vacuum consumers, engine speed, engine temperature, catalyst temperature, boost level, MAF, ambient conditions (temperature, pressure, humidity.), etc.

After 302, method 300 proceeds to 304. At 304, method 300 includes determining a desired combined motive flow rate through a parallel arrangement of two or more valved aspirators. In one example, the determination may be made at controller 50 based on signals received from one or more of MAP sensor 60, vacuum sensor 40, MAF sensor 58, and/or based on a position of throttle 22 (e.g., which may be indicative of a vehicle operator torque request) and a position of brake pedal 134. Thus, the determination may be made based on one or more of a desired engine air flow rate, stored vacuum level, and current vacuum requests, among other examples.

After 304, method 300 proceeds to 306. At 306, method 300 includes controlling the ASOVs (e.g., the valves of the valved aspirators) to achieve the desired combined motive flow rate (e.g., the desired combined motive flow rate determined at 304). For example, the ASOVs may be controlled in accordance with the methods of FIGS. 5 and 6, and based on the graph and table depicted in FIGS. 4A-B.

Figures 4A, 4B:
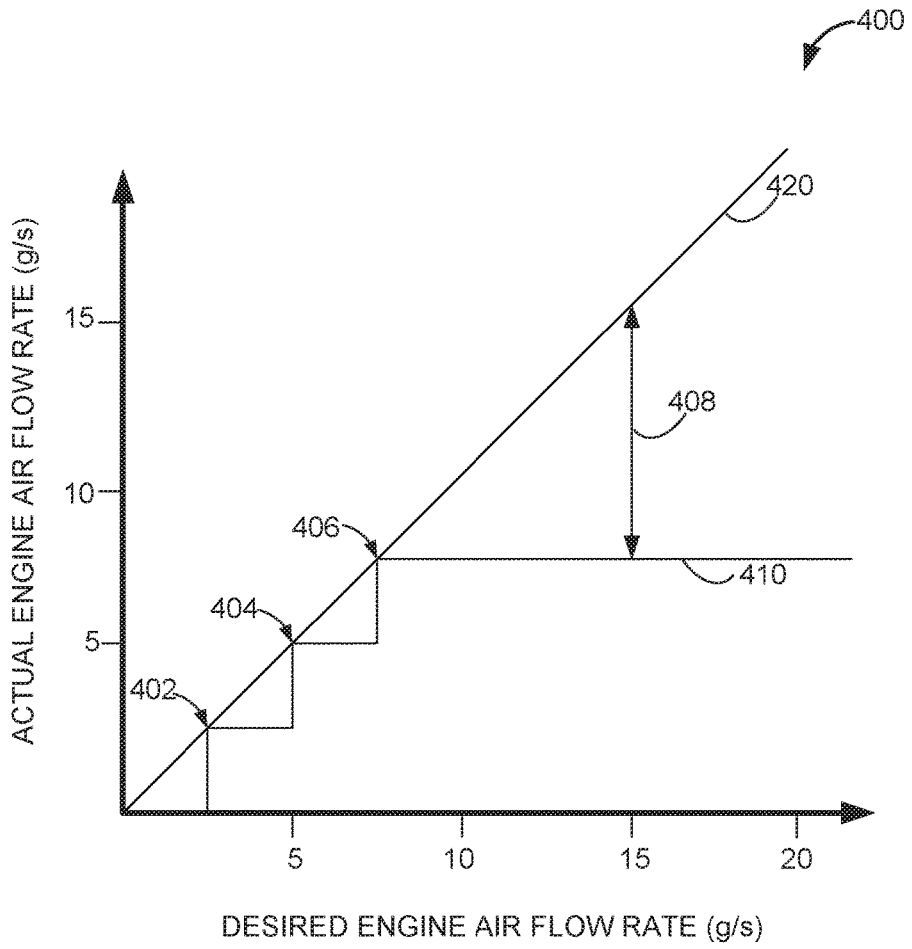
FIG. 4A shows a graph of an ideal performance of an aspirator arrangement and an actual performance of an exemplary aspirator arrangement as relates to engine air flow rate.
FIG. 4B shows a table relating aspirator shut-off valve position to a combined motive flow rate through the exemplary aspirator arrangement of FIG. 4A and intake manifold vacuum level for the exemplary aspirator arrangement.

FIG. 4A shows a graph 400 of an ideal performance characteristic of an aspirator arrangement as well as an actual performance characteristic of an aspirator arrangement including two parallel aspirators having throat flow areas in a ratio of 1:2, in a system such as the engine system of FIG. 1. The ideal performance characteristic is shown at 420, and the actual aspirator arrangement performance characteristic is shown at 410. The x-axis represents desired engine air flow rate (g/s), and the y-axis represents actual engine air flow rate (g/s). Desired engine air flow rate may be determined based on engine operating conditions, e.g. MAP/MANVAC, a torque request from a vehicle operator, brake pedal position, etc. Actual engine air flow rate may be measured and/or estimated based on signals from sensors such as MAF sensor 58 or based on various engine operating conditions (e.g., throttle position and positions of valves such as ASOVs). The numerical air flow rate values shown in graph 400 are for exemplary purposes only, and are non-limiting. Further, it will be appreciated that the dimensions of graph 400 are non-limiting; for example, instead of air flow rate, the axes could represent flow area (e.g., flow area of the throttle and/or aspirator).

As may be seen, the ideal performance characteristic 420 has a constant slope (specifically, a slope of 1 in the depicted example). Thus, in the depicted example, actual engine air flow rate is equal to desired engine air flow rate at any given point on the characteristic. In contrast, the actual aspirator arrangement performance characteristic 410 includes "steps" corresponding to the opening/closing of the ASOVs corresponding to the two parallel aspirators. At points 402, 404, and 406 which are arranged at corners of the steps, characteristics 420 and 410 intersect; at these points, the performance of the aspirator arrangement is the same as the performance of an ideal aspirator arrangement for the corresponding desired engine air flow rate and actual engine air flow rate. For aspirator arrangements with more than two parallel aspirators, the steps on such a graph will be smaller (e.g., the more aspirators, the smaller the steps). The relative throat flow areas of the aspirators in an aspirator arrangement will also affect the size of the steps (and thus the frequency of intersection between the actual and ideal performance characteristics). In embodiments where the ASOVs are continuously variable valves, further fine-tuning of performance of the aspirator arrangement may be achieved such that the aspirator arrangement performance characteristic conforms still further to the ideal performance characteristic.

As shown in graph 400, actual aspirator arrangement performance characteristic 410 reaches a maximum at point 406 (corresponding to an actual engine air flow rate and desired engine air flow rate which is between 5 and 10 g/s). As will be described with reference to FIG. 4B, this maximum corresponds to a maximum combined flow rate through the aspirator arrangement when both aspirators are fully open. Accordingly, as the aspirator arrangement may not be able to provide an air flow rate surpassing this maximum valve, it may be necessary to allow at least some intake air to travel via another path from the high pressure source (e.g., the intake passage) to the low pressure sink (e.g., the intake manifold). For example, if the aspirator arrangement is positioned as shown in FIG. 1, between the intake passage and intake manifold, it may be necessary to at least partially open the intake throttle such that a difference between the maximum combined flow rate through the aspirator and the desired engine air flow rate (e.g., the air flow rate which would ideally be achieved for the desired engine air flow rate), may be provided by air flow throttled by the intake throttle. For example, as shown in graph 400, when the desired engine air flow rate is 15 g/s, the actual engine air flow rate provided by the aspirator arrangement is between 5 and 10 g/s (e.g., the maximum combined flow rate). The arrow labeled 408 indicates a difference between the engine air flow rate achieved by an ideal aspirator arrangement at a desired engine air flow rate of 15 g/s and the engine air flow rate actually achieved by an exemplary aspirator arrangement at the same desired engine air flow rate. As will be described below with reference to FIG. 6, when the intake throttle is operating correctly, its position may be adjusted such that an air flow rate through the throttle may be added to the combined motive flow rate through the aspirator arrangement to achieve the desired engine air flow rate. Depending on engine operating conditions such as stored vacuum and current vacuum requests, and depending on whether it is desirable to prioritize engine air flow rate or to minimize throttling losses, it may be desirable to direct more or less intake air through the aspirator arrangement versus through the intake throttle.

FIG. 4B depicts a table 450 relating the position of two ASOVs controlling fluid flow through aspirators with different-sized throat flow areas to the combined motive flow rate through the aspirator arrangement and the intake manifold vacuum level. Table 450 is directed to an embodiment where the aspirator arrangement includes exactly two aspirators in parallel, a first, smaller aspirator with a throat diameter of 3.5 mm and a second, larger aspirator with a throat diameter of 5 mm (which results in a throat flow area at the second aspirator which is approximately two times as large as a throat flow area at the first aspirator). However, it will be appreciated that similar tables could be created for aspirator arrangements having a different number of aspirators and/or having aspirators with different relative throat diameters/cross-sectional flow areas.

As shown in the first row of table 450, when the intake manifold vacuum level is greater than 40 kPa (e.g., when a negative pressure of less than 40 kPa is present in the intake manifold), the engine may be unable to afford any throttle bypass flow. Accordingly, during such conditions, it may be desirable to close both ASOVs such that a combined motive flow through the aspirator arrangement is 0. Closing the ASOVs may be an active process in embodiments where the ASOVs are solenoid valves (e.g., the ASOVs may be controlled by a controller such as controller 50 of FIG. 1). Alternatively, in embodiments where the ASOVs are passive valves such as vacuum-actuated valves, each ASOV may be coupled to a vacuum source and may be opened/closed based on a vacuum level at the vacuum source; for example, the vacuum source may be the intake manifold and both ASOVs may be designed to be closed when intake manifold vacuum is greater than 40 kPA. At this time, all intake air flow may be directed towards the intake throttle, and a position of the intake throttle may be controlled based on a desired engine air flow rate.

The second row of table 450 corresponds to an intake manifold vacuum level of between 35 kPa and 40 kPa (e.g., a pressure in the intake manifold which is less than −35 kPa but greater than or equal to −40 kPa). When intake manifold vacuum is in this range, it may be desirable to have a first level of combined motive flow rate through the aspirator arrangement. The first level of combined motive flow rate may be achieved by opening the ASOV corresponding to the first, smaller aspirator and closing the ASOV corresponding to the second, larger aspirator. The first level of combined motive flow rate may correspond to point 402 of FIG. 4A, for example.

The third row of table 450 corresponds to an intake manifold vacuum level of between 30 kPa and 35 kPa (e.g., a pressure in the intake manifold which is less than −30 kPa but greater than or equal to −35 kPa). When intake manifold vacuum is in this range, it may be desirable to have a second level of combined motive flow rate through the aspirator arrangement. The second level of combined motive flow rate may be achieved by opening the ASOV corresponding to the second, larger aspirator and closing the ASOV corresponding to the first, smaller aspirator. The second level of combined motive flow rate may correspond to point 404 of FIG. 4A, for example.

The fourth row of table 450 corresponds to an intake manifold vacuum level of less than or equal to 30 kPa and greater than 0 kPa (e.g., a pressure in the intake manifold which is greater than −30 kPa and less than 0 kPa). When intake manifold vacuum is in this range, it may be desirable to have a third level of combined motive flow rate through the aspirator arrangement. The third level of combined motive flow rate may be achieved by opening both the ASOV corresponding to the second, larger aspirator and the ASOV corresponding to the first, smaller aspirator. The third level of combined motive flow rate may correspond to point 406 of FIG. 4A, for example, e.g., it may correspond to the maximum combined flow rate described above.

Because of the 1:2 ratio of the cross-sectional flow areas at the throats of the aspirators of the example aspirator arrangement referred to in FIGS. 4A-B, the first, second, and third levels may correspond to flow rates which are multiples of a common factor x. That is, the first level of combined motive flow rate may have a value x, the second level of combined motive flow rate may have a value of 2*x, and the third level of combined motive flow rate may have a value of 3*x. In examples where there is a different relationship between the cross-sectional flow areas of the throats of the aspirators of the aspirator arrangement, and in examples where a different number of aspirators are included in the aspirator arrangement, the mathematical relationship between the different flow rate levels achievable with the aspirator arrangement may be different, without departing from the scope of the present disclosure.

Now referring to FIG. 5, an example method 500 for controlling the operation of the aspirator arrangement is shown.

At 502, method 500 includes measuring and/or estimating engine operating conditions, for example in the manner described above for step 302 of method 300.

After 502, method 500 proceeds to 504. At 504, method 500 includes determining a desired engine air flow rate. For example, desired engine air flow rate may be determined based on engine operating conditions, e.g. MAP/MANVAC, a torque request from a vehicle operator, brake pedal position, etc.

After 504, method 500 continues to 506. At 506, method 500 includes determining whether throttle fault conditions are present. In one non-limiting example, control system 46 may set a flag when diagnostic procedures indicate failure of the electronic throttle control system, and the determination of whether throttle fault conditions are present may include checking whether this flag is set. Alternatively, the determination may be made based on readings from the MAP sensor, MAF sensor, and/or various other sensors.

If the answer at 506 is NO, this indicates that throttle fault conditions are not present (e.g., electronic throttle control is functioning correctly), and method 500 proceeds to 508. At 508, method 500 includes determining whether engine operating conditions permit throttle bypass. For example, during certain engine operating conditions, engine air flow requirements may be such that a fully open throttle and no throttle bypass is necessary. Alternatively, during other engine operating conditions, it may be desirable to divert intake air flow through an aspirator arrangement to thereby generate vacuum for consumption by vacuum consumers of the engine system while avoiding throttling losses.

If the answer at 508 is YES, indicating that engine operating conditions do permit throttle bypass, method 500 proceeds to 510 to determine whether the desired engine air flow rate (e.g., as determined at 504) is greater than a maximum combined motive flow rate through the aspirator arrangement. For example, as described above with reference to FIG. 4A, a maximum combined flow rate through the aspirator arrangement may be less than a desired engine air flow rate, and it may be necessary to allow some air flow to pass through the intake throttle to achieve the desired engine air flow rate.

If the answer at 510 is NO, the desired engine air flow rate is not greater than the maximum combined motive flow rate through the aspirator arrangement, and thus the throttle may be closed at 516. After 516, method 500 proceeds to 518 to control the ASOVs based on throat flow areas of the aspirators, desired engine air flow rate, and engine operating conditions. Accordingly, when throttle fault conditions are not present, engine operating conditions permit throttle bypass, and the desired engine air flow rate is less than the maximum combined motive flow rate through the aspirator arrangement, all intake air flow may be diverted around the intake throttle and through the aspirator arrangement to advantageously avoid throttling losses while generating vacuum for use by various vacuum consumers of the engine system. In some examples, control of the ASOVs may be performed in the manner described above with reference to FIGS. 4A-B; that is, for a given desired engine air flow rate, each ASOV may be either opened or closed (fully or partially) such that the flow rates through the aspirators of the arrangement add up to the desired engine air flow rate. In examples where the ASOVs are actively controlled by a controller such as controller 50 of FIG. 1, engine operating conditions such as stored vacuum level and current vacuum requests may also factor into the determination of how to control the ASOVs. For example, if current vacuum requests are very high and failure of one or more vacuum-powered engine systems is imminent if vacuum replenishment does not occur, control of the ASOVs may prioritize vacuum generation over achieving a desired engine air flow rate, for example. After 518, method 500 ends.

Returning to 510, if the answer is YES indicating that the desired engine air flow rate is greater than the maximum combined motive flow rate through the aspirator arrangement, method 500 proceeds to 512. At 512, method 500 includes controlling the ASOVs based on throat flow areas of the aspirators, desired engine air flow rate, and engine operating conditions, and further at least partially opening the throttle. In one example, step 512 may be performed in accordance with method 600 of FIG. 6, which will be described below. After 512, method 500 ends.

Returning to 508, if the answer is NO indicating that engine operating conditions do not permit throttle bypass (e.g., all intake air must pass through the throttle), method 500 proceeds to 514. Engine operating conditions may not permit throttle bypass during conditions where a wide open throttle position is necessary and where any lag associated with the flow restrictions of aspirators is unacceptable. As another example, if the control system diagnoses a fault in one or more of the ASOVs, this may constitute an engine operating condition wherein throttle bypass is not permitted. At 514, method 500 includes closing the ASOVs and controlling the throttle based on the desired engine air flow rate and engine operating conditions. In some examples, this may include increasing opening of the throttle as a pressure exerted on an accelerator pedal by a vehicle operator increases. After 514, method 500 ends.

Returning to 506, if the answer at 506 is YES indicating that throttle fault conditions are present, method 500 proceeds to 518 to control the ASOVs in the manner described above. Engine systems including the aspirator arrangements described herein may utilize intake throttles which do not have a costly partially-open unpowered position; instead, they may utilize intake throttles with fully closed unpowered positions, because the aspirator arrangement may provide sufficient engine air flow at controllable levels during the limp home operation described above. Accordingly, during throttle fault conditions where the throttle is in its default, unpowered closed position, the ASOVs alone may be controlled to achieve the desired engine air flow rate.

Figure 2:
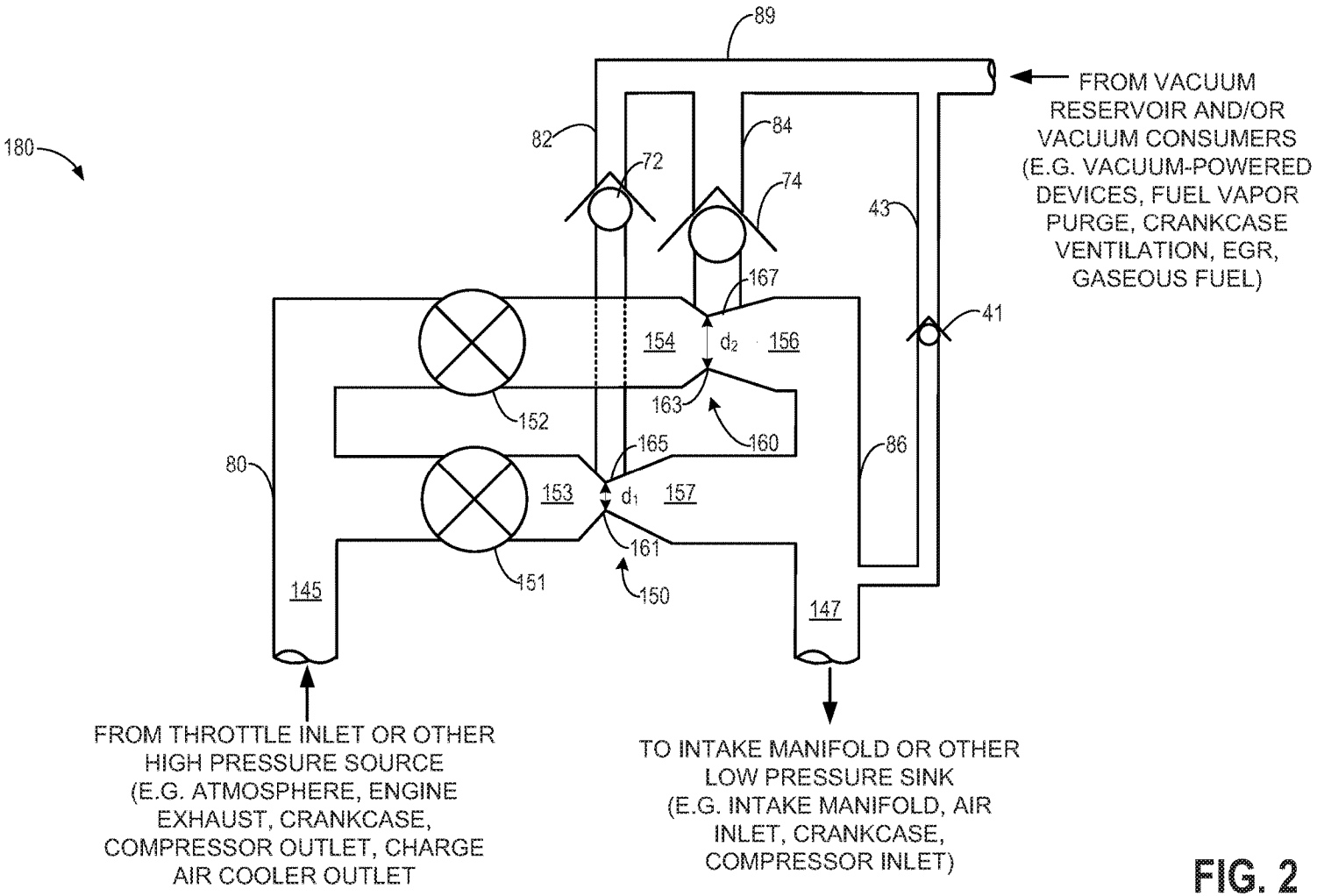
FIG. 2 shows a detail view of an aspirator arrangement which may be included in the engine system of FIG. 1.

Now referring to FIG. 6, an example method 600 for controlling the intake throttle and the ASOVs in an engine system such as engine system 10 of FIG. 1 with an aspirator arrangement such as aspirator arrangement 180 depicted in FIGS. 1-2 is provided. Method 600 may be used in conjunction with method 300 of FIG. 3 and method 500 of FIG. 5, for example. While method 600 is directed to an embodiment wherein the aspirator arrangement includes exactly two aspirators, a smaller aspirator and a larger aspirator (where smaller and larger are relative terms referring to the sizes of the throat cross-sectional flow areas of the aspirators), it will be appreciated that variations of method 600 which apply to other aspirator arrangements may be used without departing from the scope of the present disclosure.

At 602, method 600 includes determining if the intake manifold pressure (MAP) is less than a first threshold. In one non-limiting example, the first threshold may be −40 kPa (e.g., equivalent to a MANVAC of 40 kPA). If MAP is less than the first threshold, the answer at 602 is YES, and method 600 proceeds to 612 where both ASOVs may be adjusted to the closed position. As described above, closing both ASOVs may be performed actively by controller 50, or may be a passive process occurring based on vacuum levels in the engine system (e.g., based on MANVAC). It will be appreciated that if the ASOVs are already closed (e.g., from a previous iteration of method 500 or 600), step 612 may include taking no action such that both ASOVs remain closed. By ensuring that both ASOVs are in a closed position, throttle bypassing may be prevented such that engine air flow is limited to air flow through the throttle (e.g., combined motive flow rate through the aspirator arrangement is zero or an insubstantial leakage flow rate). After 612, method 600 proceeds to step 610 which will be described below.

In addition to the conditions for closing the ASOVs for all aspirators described for step 612, it will be appreciated that in the case of a boosted engine, where MANVAC may have a negative value during certain conditions, the controller may optionally choose to close the ASOVs for all aspirators to prevent reverse flow from MAP to CIP (e.g., in systems where the aspirator arrangement bypasses from MAP to CIP). However, in systems where the aspirator arrangement bypasses from TIP to MAP, there may not be potential for reverse flow.

Returning to step 602, If MAP is not less than the first threshold, the answer is NO, and method 600 proceeds to 604. At 604, method 600 includes determining if MAP is greater than or equal to the first threshold and less than a second threshold. In one non-limiting example, the second threshold may be −35 kPa (e.g., equivalent to a MANVAC of 35 kPa). If MAP is greater than or equal to the first threshold and less than the second threshold, the answer at 604 is YES, and method 600 proceeds to 614. At 614, method 600 includes opening the ASOV for the smaller aspirator and closing the ASOV for the larger aspirator. For example, as detailed above with respect to the second row of table 450 of FIG. 4B, controlling the ASOVs in this manner may achieve a first level of motive flow rate which is appropriate when MAP is greater than or equal to the first threshold and less than the second threshold. After 614, method 600 proceeds to step 610 which will be described below.

Returning to 604, if the answer is NO, method 600 proceeds to 606 to determine if MAP is greater than or equal to the second threshold and less than a third threshold. In one non-limiting example, the third threshold may be −30 kPa (e.g., equivalent to a MANVAC of 30 kPa). If MAP is greater than or equal to the second threshold and less than the third threshold, the answer at 606 is YES, and method 600 continues to 616. At 616, method 600 includes opening the ASOV for the larger aspirator and closing the ASOV for the smaller aspirator. For example, as detailed above with respect to the third row of table 450 of FIG. 4B, controlling the ASOVs in this manner may achieve a second level of motive flow rate which is appropriate when MAP is greater than or equal to the second threshold and less than the third threshold. After 616, method 600 proceeds to step 610 which will be described below.

However, if the answer at 616 is NO, MAP may be greater than or equal to the third threshold (e.g., −30 kPa). Accordingly, in this case, method 600 proceeds to 608 to open both ASOVs. For example, if MAP is greater than or equal to the third threshold, engine operating conditions may permit an increased throttle bypass flow rate, and therefore it may be desirable to open both ASOVs (or, all ASOVs in configurations with more than two parallel aspirators) in order to maximize the combined motive flow rate through the aspirator arrangement, thereby maximizing vacuum generated via the aspirator arrangement and minimizing throttling losses.

After 608 (as well as after each of steps 612, 614, and 616), method 600 proceeds to 610. At 610, method 600 includes adjusting throttle position based on the difference between the desired engine air flow rate and the combined motive flow rate through the aspirators. For example, as described above with reference to graph 400 of FIG. 4A, during some engine operating conditions, the desired engine air flow rate may be higher than a maximum combined motive flow rate through the aspirator arrangement. Accordingly, during such conditions, it may be necessary to at least partially open the intake throttle such that additional intake air flow may pass through the throttle to the intake manifold to supplement the air flow through the aspirator arrangement. It will be appreciated adjustment of the throttle position may be performed by controller 50 based on a determination of an appropriate throttle position which takes into consideration other factors in addition to the combined motive flow rate through the aspirator arrangement and the desired engine air flow rate. After 610, method 600 ends.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. An engine system, comprising: a plurality of aspirators coupled with an engine intake system: a first passage branching into parallel flow paths, each aspirator arranged in one of the parallel flow paths forming a parallel flow configuration; a second passage into which the parallel flow paths merge downstream of the aspirators; and a plurality of vacuum-actuated valves having different vacuum actuation thresholds from one another, each valve arranged in series with a corresponding one of the aspirators in a parallel flow path of the corresponding aspirator.

2. The engine system of claim 1, wherein the first passage is fluidly coupled to a high pressure source and the second passage is fluidly coupled to a low pressure sink.

3. The engine system of claim 2, wherein the high pressure source is an inlet of a compressor and the low pressure sink is an outlet of an intake throttle.

4. The engine system of claim 2, wherein the high pressure source is an inlet of an intake throttle and the low pressure sink is a compressor inlet.

5. The engine system of claim 2, wherein the high pressure source is an inlet of an intake throttle and the low pressure sink is an outlet of an intake throttle.

6. The engine system of claim 1, wherein each valve is arranged upstream of the corresponding one of the aspirators in the parallel flow path of the corresponding aspirator.

7. The engine system of claim 1, wherein each valve is arranged downstream of the corresponding one of the aspirators in the parallel flow path of the corresponding aspirator.

8. An engine system, comprising: a plurality of aspirators coupled with an engine intake system: a first passage branching into parallel flow paths, each aspirator arranged in one of the parallel flow paths forming a parallel flow configuration; a second passage into which the parallel flow paths merge downstream of the aspirators; a plurality of electrically-actuated valves, each valve arranged in series with a corresponding one of the aspirators in the parallel flow path of the corresponding aspirator; and a controller with computer readable instructions actively controls individual valves and flow through individual aspirators.

9. The engine system of claim 8, wherein the first passage is coupled to an engine intake passage upstream of an intake throttle, and wherein the second passage is coupled to the engine intake passage downstream of the intake throttle.

10. The engine system of claim 9, wherein the controller actively controls the valves based on a desired engine air flow rate.

11. The engine system of claim 10, wherein the controller further comprises computer readable instructions for controlling the intake throttle based on a difference between a current combined motive flow rate through the plurality of aspirators and the desired engine air flow rate.

12. The engine system of claim 11, wherein the controller further comprises computer readable instructions for closing the intake throttle when the desired engine air flow rate is less than a threshold corresponding to a maximum combined motive flow rate through the plurality of aspirators, and at least partially opening the intake throttle when the desired engine air flow rate is greater than the threshold.

13. The engine system of claim 11, wherein a default position of the intake throttle is a fully closed position, and wherein the controller further comprises computer readable instructions for, during a fault condition of the intake throttle, directing all intake air flow through the plurality of aspirators and controlling the valves based on the desired engine air flow rate.

14. A method for an engine, comprising:

actively adjusting individual opening amounts of a plurality of electrically-actuated aspirator shut-off valves with an electronic control system based on a desired engine air flow rate, the individual opening amounts controlling flow through a corresponding aspirator, each shut-off valve arranged in series with a corresponding one of a plurality of aspirators, the aspirators and the corresponding shut-off valves arranged in a corresponding parallel flow path and in parallel configuration with one another and with an intake throttle.

15. The method of claim 14, wherein the active adjustment is performed during a fault condition where the intake throttle is fully closed.

16. The method of claim 15, further comprising:

when the intake throttle is not in the fault condition:

if the desired engine air flow rate is greater than a maximum combined motive flow rate through the plurality of aspirators, adjusting an opening amount of the intake throttle with the electronic control system based on a difference between the desired engine air flow rate and the maximum combined motive flow rate through the plurality of aspirators, and fully opening all of the shut-off valves with the electronic control system; and if the desired engine air flow rate is not greater than the maximum combined motive flow rate through the plurality of aspirators, closing the intake throttle with the electronic control system and adjusting an opening amount of each shut-off valve with the electronic control system based on a throat flow area of the corresponding aspirator and based on the desired engine air flow rate.

17. The method of claim 14, wherein the active adjustment of the shut-off valves is further based on a level of stored vacuum and current vacuum requests.

18. The method of claim 14, wherein the shut-off valves are continuously variable valves.

19. The method of claim 14, wherein the shut-off valves are binary valves.

20. The method of claim 14, further comprising, with the electronic control system:

during a first mode, opening none of the shut-off valves;

during a second mode, opening one of the shut-off valves; and during a third mode, opening at least two of the shut-off valves.

* * * * *